United States Patent [19]

Hamilton et al.

[11] 4,193,745

[45] Mar. 18, 1980

[54] GEAR PUMP WITH MEANS FOR DISPERSING GAS INTO LIQUID

[75] Inventors: William M. Hamilton, Lorain; Charles H. Scholl, Vermilion; Jeffrey J. Kruke, Lorain; Larry D. Akers, Vermilion, all of Ohio

[73] Assignee: Nordson Corporation, Amherst, Ohio

[21] Appl. No.: 884,826

[22] Filed: Mar. 9, 1978

[51] Int. Cl.[2] ..... F04C 1/08; F04C 13/00; F04C 11/00; B01F 5/14

[52] U.S. Cl. ..... 418/9; 418/15; 418/75; 418/206; 261/28; 261/84; 366/272

[58] Field of Search ..... 418/9, 15, 75, 78, 205, 418/206; 261/28, 84; 366/262, 272, 302, 303

[56] References Cited

U.S. PATENT DOCUMENTS

| | | | |
|---|---|---|---|
| 2,578,380 | 12/1951 | Teegen | 261/84 |
| 2,845,873 | 8/1958 | Lapsley | 418/75 |
| 3,606,269 | 9/1971 | Trumbull | 366/303 |
| 3,689,181 | 9/1972 | Maxwell | 425/207 |
| 3,764,238 | 10/1973 | Carpigiani | 418/15 |
| 3,965,860 | 6/1976 | Cone et al. | 261/28 |
| 4,059,466 | 11/1977 | Scholl et al. | 261/28 |
| 4,059,714 | 11/1977 | Scholl et al. | 261/28 |

*Primary Examiner*—John J. Vrablik

*Attorney, Agent, or Firm*—Wood, Herron & Evans

[57] ABSTRACT

A gear pump for dispersing a gas into a liquid is provided with mixing means for improving the uniformity of the dispersion. In preferred form, the mixing means comprises a series of fixed, shallow, blind cavities that open to the pumping cavity between the liquid inlet and the outlet, and which are positioned to be "wiped" by the gear teeth as the gears rotate. The alternate connection and disconnection of the intertooth spaces to these cavities as the gears rotate establishes motion or turbulence of the gas/liquid mixture within the intertooth spaces, and surprisingly improves uniformity of the dispersion.

17 Claims, 8 Drawing Figures

GEAR PUMP WITH MEANS FOR DISPERSING GAS INTO LIQUID

FIELD OF THE INVENTION

This invention relates to gear pumps of the type which mix a gas with a liquid. More particularly, the invention relates to a gear pump having mixing means for uniformly dispersing a gas into a liquid such as a molten hot melt adhesive to form a solution of the gas in the liquid. The invention is primarily described in relation to that environment, although these pumps are also useful for other gas/liquid mixing and pumping applications.

BACKGROUND OF THE INVENTION

It has recently been discovered that the strength of an adhesive bond between two substrates, for a given quantity of a selected hot melt adhesive, can be substantially improved if the adhesive is used as a cellular foam, rather than in the conventional way as a molten but unfoamed adhesive. This discovery is described at greater length in Scholl et al U.S. Pat. Nos. 4,059,466 and 4,059,714, both issued Nov. 22, 1977, entitled "Hot Melt Thermoplastic Adhesive Foam System", and assigned to the assignee of this application, the disclosures of which are hereby incorporated by reference in this application. As shown in those patents, the higher bonding strength of a hot melt adhesive, when foamed, results at least in part from the fact that the foam can be spread over a larger area, under the same compressive conditions, than an equal weight of the same adhesive which has not been foamed. The foam has also been found to have a longer "open" time, after it has been deposited onto a first substrate and during which it can effectively bond to a second substrate when pressed against the latter, yet it has a shorter "tack" time, i.e., it will set up and adhere faster after it has been compressed between two substrates. These characteristics are advantageous in many applications where hot melt adhesives are used.

Hot melt adhesive foams can be produced by mixing a gas such as air or nitrogen, under pressure, with molten hot melt adhesive. when the liquid adhesive/gas mixture is subsequently dispensed, as from a conventional valved type of adhesive dispenser or gun, the gas forms small bubbles throughout the mass, causing the adhesive to expand volumetrically as a foam. If the foam were left in an uncompassed state, it would set up with the air or other gas cells distributed throughout it. However, if the foam is pressed between two substrates before it has cooled, a substantial proportion of the bubbles are crushed, the gas is essentially dispelled from the adhesive, and the adhesive provides the advantageous characteristics mentioned above.

PRIOR ART HOT MELT ADHESIVE FOAM PUMPS

As shown in U.S. Pat. No. 4,059,714, it is advantageous to use a gear pump to disperse the gas into the liquid hot melt adhesive. Both single and double stage gear pumps are shown in that patent, using intermeshed pairs of spur gears enclosed in pumping chambers. The thermoplastic adhesive is melted in a reservoir and the liquid is introduced to the pumping chamber through a liquid inlet port located between the two gears, where their teeth are just coming out of mesh. In one embodiment, two gas inlet ports are provided, one for each of the two gear lobes of the pumping chamber. Each gas inlet enters its respective lobe in the pumping chamber at a position spaced downstream (i.e., in the direction of gear rotation) from the liquid inlet port, and it is separated from the liquid inlet by one or more gear teeth. The liquid and gas are received in the spaces between the teeth of the respective gears and are carried in those spaces around the periphery of the pumping chamber as the gears rotate. Within the pumping chamber the gas and liquid are mixed and the gas is forced into what is believed to be a true solution in the liquid. At the outlet, where the teeth are again coming into mesh, as the tooth of one gear moves into an intertooth space of the opposite gear, the liquid in that space is positively displaced from it. The gas/liquid adhesive solution, under pump outlet pressure, is supplied to a valved type of adhesive dispenser, from which the adhesive can be selectively dispensed at atmospheric pressure.

In the co-pending application of Akers and Scholl, Ser. No. 874,333, filed Feb. 1, 1978, entitled "Hot Melt Adhesive Foam Pump System", there is described an improved two-stage gear pump system. The first stage pump is a liquid metering pump which delivers hot melt adhesive at a constant rate to the second stage pump. The gas is added only in the second stage, to the liquid supplied from the first stage. That system is less sensitive to changes in adhesive viscosity and pump speed, and provides greater uniformity of foam density and output flow when the adhesive is ejected from a dispenser connected to the pump.

In the second stage of that pump, wherein the gas and liquid are first brought together and mixed, the molten adhesive and gas are introduced through separate, spaced ports, the liquid inlet port being upstream of the respective gas inlet ports. The application explains the sequence of first admitting the molten adhesive into the respective intertooth spaces, then subsequently filling the remaining volume of the respective spaces with the gas, helps insure that the spaces receive the adhesive and gas in desired ratio. If the respective intertooth space were first filled with gas, the compressibility of the gas could result in a "bubble" that would substantially fill the entire space. The bubble would resist entry of the liquid adhesive into that space, and thereby might lead to a higher gas/liquid ratio and foam inhomogeneity.

OBJECT OF THE INVENTION

Generally hot melt adhesives are extremely viscous when molten. In general, their consistency at use conditions is similar to that of molten glass or molasses. They flow poorly in comparison to other materials, and the flow characteristics of many are non-Newtonian. Moreover, the viscosity of any given adhesive will vary sharply with temperature. Since a given pump may be used with a range of different adhesives, at different temperatures, gas/liquid ratios and pressures, and at different output cycles, it is desirable to provide a pump that will deliver the foam at a high degree of uniformity under all the various different operating conditions that might be expected to be encountered.

Against this background, it has been the objective of the present invention to provide means for improving the uniformity of the dispersion of a gas in a liquid, particularly of an inert gas in a hot melt adhesive.

BRIEF DESCRIPTION OF THE INVENTION

The invention provides a new type of mixing means which is static, that is, it does not require any input motion or energy, other than the rotation of the gears themselves. This mixing means is provided in the pumping chamber itself, between the liquid inlet and the outlet.

Ordinarily, as in previous gas/liquid gear pumps, when a given quantity of liquid and gas have been received in a given intertooth space, that space is thereafter substantially sealed (by the walls of the pumping chamber) while the space moves toward the outlet. No forces, other than those forces resulting from the rotation of the gear itself, act on the fluid in that space.

The invention arises from the concept of "pulsing" the fluid mixture in the respective intertooth spaces, as the spaces move from inlet to outlet, thereby to increase the mixing forces. This is accomplished by placing each intertooth space rapidly into and out of communication with small chambers opening to the pumping cavity, each containing a quantity of the gas/liquid mixture. While the precise mechanism of mixing that results from such sequential pulsing is not fully understood, it has been observed that foams produced by such pumps display an exceptionally high degree of uniformity. Moreover, use of these mixing means enables a higher ratio of gas to be mixed into hot melt without any "spitting" which would indicate the presence of undissolved gas.

More particularly, in a preferred embodiment of this invention the mixing means comprises a series of small, shallow fixed cavities that open to the pumping chamber, and which are positioned so that they are sequentially "wiped" or traversed by the teeth of the respective gear as the gear rotates. The intermittent exposure (to the intertooth spaces) of these cavities as the gear teeth pass them is believed to establish turbulence within the liquid and gas in the intertooth spaces, which aids dispersion of the gas in the liquid. The cavities are preferably formed as shallow blind drill holes in the plates that form the pumping chamber, on the opposite faces of the gears. Preferably, separate sets of such cavities are provided, one adjacent the inlet and another adjacent the outlet in each gear lobe.

DETAILED DESCRIPTION OF THE DRAWINGS

The invention can best be further described by reference to the accompanying drawings, in which.

Figure 1:
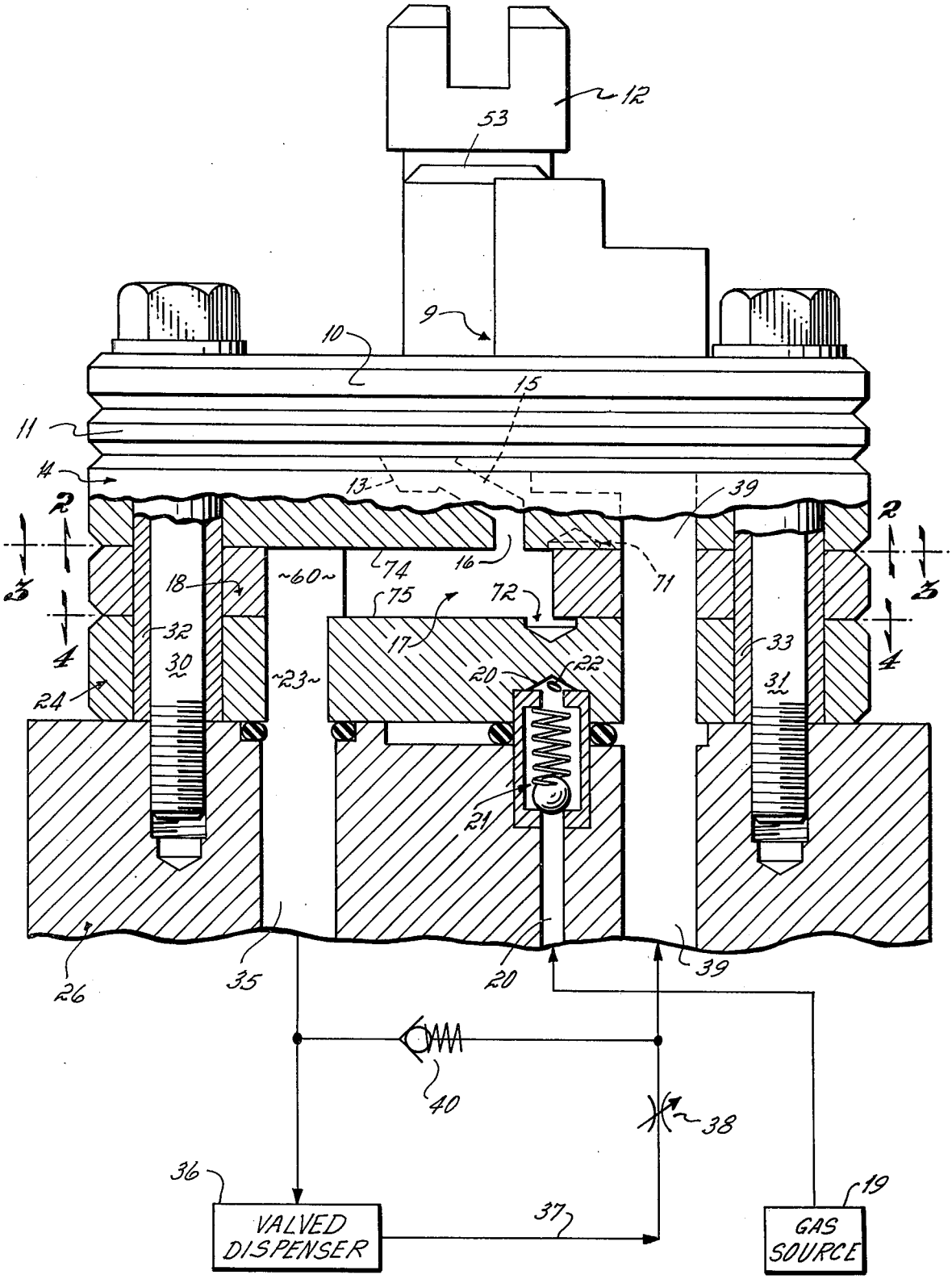
FIG. 1 is a side elevation, partly in axial section and somewhat diagrammatic, of a two-stage gear pump having inlet mixing and outlet mixing means, both in accordance with the preferred embodiment of the invention, incorporated in the second stage pump.

In the preferred embodiment, the invention is used in a two-stage gas/liquid gear pump of the type which forms the subject of the co-pending application of Akers and Scholl, Ser. No. 874,333, filed Feb. 1, 1978, previously referred to herein. The pump shown in FIG. 1 is in overall construction generally similar to the pump shown in FIG. 2 of the Akers and Scholl application, to which reference may be had for a more detailed description.

By way of brief background description of that overall pump, a feed stream of previously melted hot melt adhesive is supplied through an inlet indicated at 9 and flows through an internal passage (not shown) in a first stage inlet plate 10 to a first stage gear pump that is housed in a first stage pump plate 11. The first stage pump, as well as the second stage pump to be described, comprises a pair of intermeshed spur gears. One gear of each stage is coupled to and driven by a shaft 12 that is in turn rotated by a motor drive not shown. No gas is mixed with the liquid hot melt in the first stage, in this embodiment. The first stage pump delivers the liquid hot melt to a first stage outlet port indicated by dotted lines at 13, which is formed as a recess on the top side of a first-second stage separator plate 14. From port 13 the liquid material flows through a diagonal bore 15 to a second stage liquid inlet bore 16, all formed in plate 14.

Figure 3:
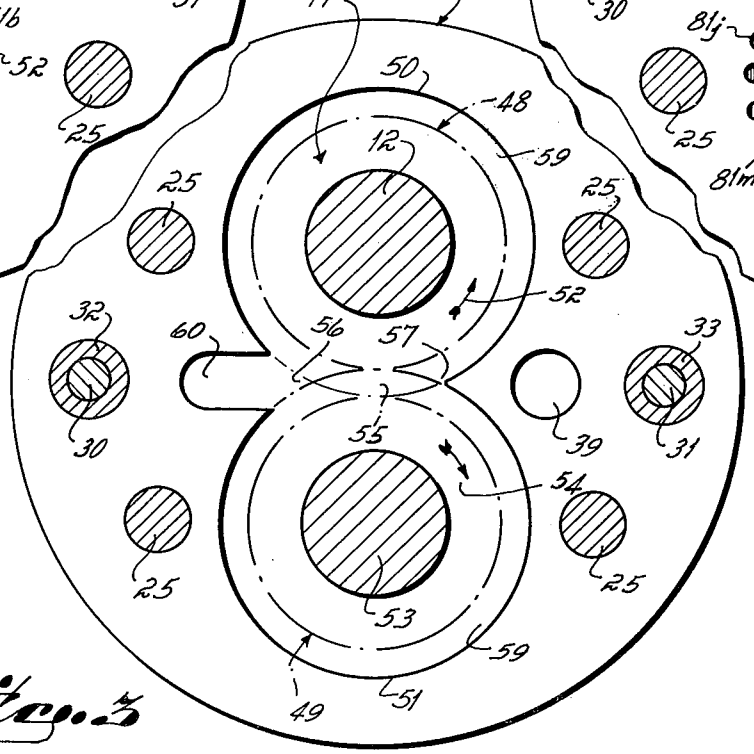
FIG. 3 is a horizontal section taken on line 3—3 of FIG. 1, looking downward.
Figure 6:
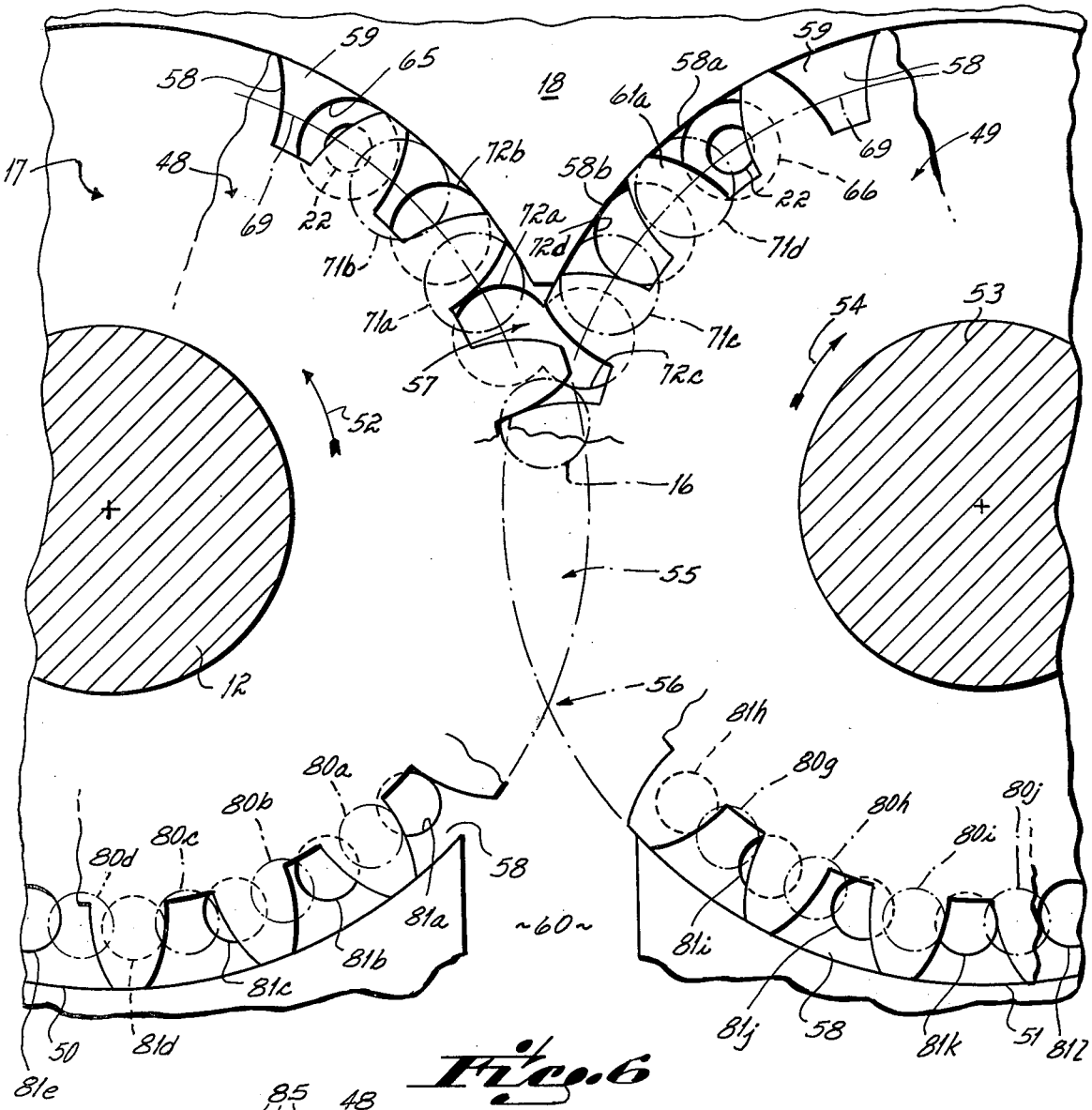
FIG. 6 is an enlarged fragmentary view similar to FIG. 3, showing superimposed the preferred placement of the inlet and the outlet mixing cavities in relation to the second stage inlet and outlet ports.

As shown in FIG. 3, the second stage pump in this embodiment comprises a pair of gears 48 and 49, which rotate in the respective lobes 50 and 51 of a pumping chamber 17 formed in the second stage pump plate 18. For simplification, the gears have not been shown in the pumping chamber 17 in FIG. 1; they are shown in FIG. 6.

In the second stage, liquid adhesive incoming through port 16 is mixed with gas which is delivered to the second stage from a gas source shown diagrammatically at 19, through a passage 20, as shown in greater detail in the Akers and Scholl application. The gas inlet passage 20 includes a check valve designated generally at 21, which prevents flow of adhesive through passage 20 toward source 19. On the downstream side of check valve 21, plural gas inlet branch passages, the upstream end of one of which is designated at 22 in FIG. 1, lead to the pumping chamber 17, as will be described.

In the second stage pump the gas is thoroughly or homogeneously dispersed in the liquid hot melt adhesive, as will be described. The resulting mixture, which is believed to be a true solution, is delivered to a second stage outlet passage 23 that is formed in a second stage outlet plate 24.

Figure 4:
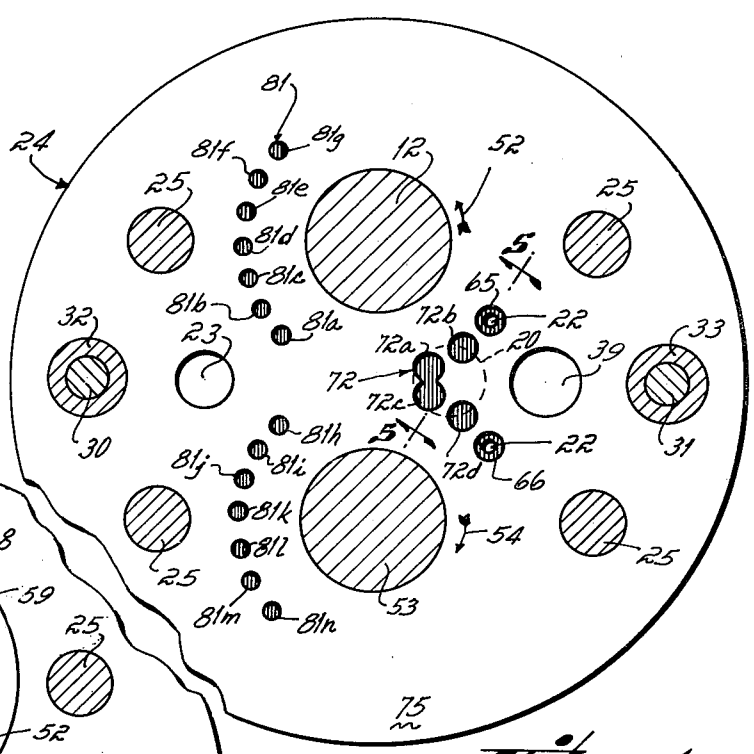
FIG. 4 is a horizontal section taken on line 4—4 of FIG. 1, looking downward.
Figure 5:
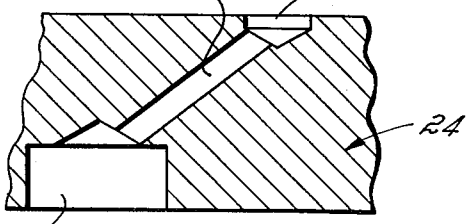
FIG. 5 is an enlarged vertical section taken on line 5—5 of FIG. 4.
Figure 2:
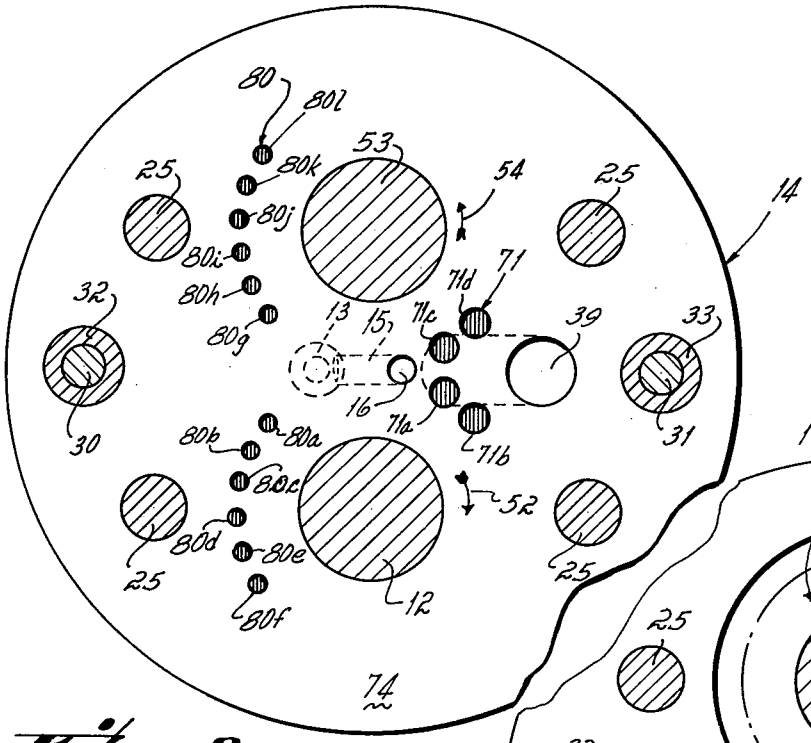
FIG. 2 is a horizontal section taken on line 2—2 of FIG. 1, looking upward.

The various plates 10, 11, 14, 18 and 24, referred to above, are aligned in stacked relation by alignment sleeves 32 and 33 (see FIG. 1), and are secured together as a subassembly by bolts 25 (see FIGS. 2–4). The plate subassembly is secured to a manifold block designated generally at 26, by mounting bolts 30, 31, which pass through the plate alignment sleeve 32, 33, respectively.

An outlet passage 35 in manifold 26 leads from the second stage outlet 23 in plate 24, and in use is connected to a valved dispenser 36 which may be a manually or solenoid operated gun of a type known per se. A return or recycle line 37 leads from dispenser 36 through a variable restrictor 38 to a recycle passage 39, in manifold 26. This passage 39 extends through plates 24, 18 and 14, and returns the recycled mixture to the intake of the first stage gears, all as described in more detail in the Akers and Scholl application. A relief valve 40, shown diagrammatically in FIG. 1, is connected between outlet passage 35 and recycle passage 39 to prevent the system pressure from exceeding a predetermined maximum limit.

In the two-stage gear pump embodiment illustrated in FIGS. 1–6, the mixing means of the invention is used in the second stage, in which the gas and liquid hot melt are brought together and mixed. In that stage a pair of gears, shown at 48 and 49 in FIG. 3, rotate within intersecting lobes 50 and 51 respectively, in pump plate 18, that together bound the pumping chamber 17. On the top and at the bottom, chamber 17 is closed by plates 14 and 24 respectively. One of the gears, gear 48, is the drive gear and is keyed to drive shaft 12. In operation, gear 48 is rotated in the direction indicated by the arrow 52. Driven gear 49 is mounted to an idler shaft 53. It meshes with gear 48 in an area 55 designated by dashed lines in FIG. 6, where lobes 50, 51 intersect. Gear 49 is rotated in the direction indicated by arrow 54.

As the gears rotate, their teeth sequentially come into mesh at 56, at one end of the mesh region 55, and come out of mesh at 57 at the opposite end of mesh region 55 (see FIG. 6). Thus the area adjacent 57 comprises the intake zone, in which the spaces 58 open as the gears come out of mesh on the low pressure side and fill with hot melt through inlet port 16. As the gears rotate in the direction of arrows 52 and 54 from inlet zone 57, fluid in intertooth spaces 58 is transferred around the sides of lobes 50 and 51 through transfer zones 59, to the area at 56. As a tooth of one gear comes into mesh with a space 58 on the opposite gear it progressively displaces fluid from that space, and the area at 56 thus comprises the outlet zone of the second stage. Zone 56 communicates with a delivery slot 60 formed in pump plate 18, and that slot in turn communicates with outlet passage 23 in second stage outlet plate 24 (see FIGS. 1 and 4).

The liquid hot melt is introduced into the second stage pump from the top side thereof (as viewed in FIG. 1) through port 16, adjacent to pump intake zone 57 (see FIG. 6). The gas is introduced somewhat downstream, i.e., in the direction of arrows 52 and 54, from liquid inlet port 16. Specifically, the gas is introduced to the pumping chamber lobes 50 and 51 through gas inlet ports 65 and 66, respectively. These ports are holes formed in the top surface 75 of plate 24 (see FIG. 4). Each of them is fed from gas supply line 20 through a separate branch passage 22, 22 in plate 24 (see FIG. 5).

The preferred positioning of gas inlet ports 65 and 66 in relation to the paths traversed by the teeth of the respective gears 48 and 49, is shown in enlarged detail in FIG. 6. Each port is preferably spaced downstream (i.e., in the direction of arrows 52 and 54) from liquid inlet port 16 by approximately the spacing between two gear teeth.

The ports 65 and 66 are preferably centered approximately on the pitch circle 69 of gears 48 and 49, and their radially outer edges lie approximately on the circumference of the lobes 50 and 51 (see FIG. 6). The diameter of each port 65, 66 is greater than the width of a single tooth, as measured on the pitch circle. By way of specific example, for a 16 diametral pitch gear having 20 teeth and a pitch diameter of 1.250", the diameter of ports 65 and 66 is preferably about 0.140". While the relative diameter and positioning described for these ports 65 and 66 is not critical in respect to gear size, they do represent the preferred embodiment, for reasons to be described. As previously noted, ports 65 and 66 are spaced downstream of liquid inlet 16 by about the spacing between the centers of two gear teeth, so that two teeth always lie between the gas and liquid inlets.

Between the gas inlet ports 65 and 66 and the liquid inlet port 16, a plurality of mixing means in accordance with the invention are formed. These mixing means are a plurality of blind cavities 71 and 72, positioned in staggered or diagonally offset relation on the surfaces 74 and 75 of plates 14 and 24 which bound the top and bottom of the pumping chamber (see FIG. 1). Preferably all of these cavities 71 and 72 are of the same diameter as gas inlet ports 65 and 66, and all lie on the pitch circle 69. In other words, they are of the same size and radial position as the ports 65 and 66. However, unlike ports 65 and 66, they are blind cavities; they are not connected to any passage in the plates.

Preferably there are at least two mixing cavities (which can be on opposite surfaces 74 and 75 to balance their effect) between each gas inlet port and the liquid inlet port 16. In the embodiment shown in FIG. 2, four mixing cavities 71*a, b, c* and *d* are formed in face 74 of plate 24, two cavities opening into each lobe 50 and 51. Four cavities 72*a, b, c* and *d*, are also formed in face 75, two opening to each lobe.

The included angle between adjacent cavities on the same plate should preferably be less than the included angle between adjacent gear teeth, and preferably is about 2 degrees less. The cavities 72 in plate 24 are at circumferential positions that are midway between the centers of cavities 71 on plate 14; that is, the opposite cavities are staggered, as can best be seen in FIG. 6. Cavities 72*a* and *c*, closest the liquid inlet 16, intersect one another in plate 24, and are offset by about half their diameter from liquid inlet port 16 in plate 14 (see FIGS. 1 and 6). In FIG. 4 it will be noted that the spacing between a gas inlet port 65 or 66 and the adjacent cavity 72*b* or 72*d* is about the same as that between each cavity and the next cavity 72*a* and 72*c*. The cavities can be formed by drilling and may be about 0.030" deep.

The provision of the mixing cavities 71 and 72 is surprisingly effective in uniformity mixing the gas into the liquid. As noted previously, the cavities are "blind", that is they lead nowhere, and nothing is introduced through them. Although we do not wish to be bound by it, our theory for this effect is believed to be as follows. Each intertooth space 58 picks up a measured volume of liquid as it sweeps past the liquid inlet port 16. The volume of liquid does not completely fill the space; as noted in the Akers and Scholl application, the second stage pump has a displacement which is greater than the volume of liquid delivered to it by the first stage, in order to accommodate the volume of gas which it must also receive. The gas being introduced via ports 65 and 66 is under pressure, which may be as high as 45 psi. Because the inlet condition is not satisfied, i.e., the spaces are not completely filled, gas will flow counter to the direction of rotation of the gears and fill the remaining volume of the spaces between the teeth. Since the mixing cavities 71 and 72 are wider than the gear teeth, each tooth is "straddled" by a cavity as the tooth passes across it; the cavity will provide a short circuit path across the tooth (from its leading side to its trailing side) through which the gas pressure is reflected back (upstream) across the tooth to the next following space. This "pressure pulse" or surge tends to increase the motion of the gas relative to the liquid in each space 58, and thereby improves mixing. More specifically, referring to FIG. 6, gas introduced through gas inlet port 66 into the intertooth space 58*a* can expand and flow into mixing cavity 71*d* and, as the gear tooth 61*a* wipes across cavity 71*d*, the gas pressure in that cavity is reflected across the tooth to the next intertooth space 58*b*, into the opposite cavity 72*d*, and so on. Thus the gas "bleeds back", i.e., upstream from the direction of gear rotation, toward liquid inlet 16. This motion and pressure cycling causes turbulence which improves mixing of the liquid and gas within the respective tooth spaces.

It is to be noted that inlet mixing holes 71 and 72 need not extend very far in the downstream direction from the liquid inlet port 16, or beyond the positions of the gas inlet ports 65 and 66. Their precise location, shape, number and diameter is not, in fact, particularly critical. In general, the mixing cavities should be positioned to provide irregular communication (as the teeth pass in rotation) with the intertooth spaces.

The mixing cavities just described can be referred to as inlet mixing means, since the cavities are adjacent the gas and liquid inlet ports. Alternatively, and preferably in addition to the inlet mixing means, a separate set of mixing cavities is also provided, closer to and upstream of the outlet zone 56 of the second stage pump. These can be referred to as the outlet mixing means. As are the inlet mixing means, the outlet mixing means are preferably in the form of blind cavities in surfaces 74 and 75 of plates 14 and 24, respectively; but they are upstream of delivery slot 60.

In the embodiment shown, several outlet mixing cavities, each designated by 80, are formed in plate 14, on each side of the outlet zone 56 (see FIGS. 2 and 6). In plate 24, on the lower side of the second stage gears, several additional cavities are formed on each side of zone 56, these each being designated at 81 (see FIGS. 4 and 6). As are the inlet mixing cavities, the several cavities 80 and 81 are blind, they may be quite shallow, and do not lead through the plates to any passage. Preferably, although not critically, they may be smaller than the inlet cavities; referring to the pump of the dimensional example given above, the outlet cavities may be drill holes 0.030" deep and 0.086" diameter, in comparison to the 0.030" depth and 0.140" diameter of the inlet cavities. The centers of the cavities 80 and 81 may lie on or near the pitch circle of gear 48 and 49, such that the radially inner edge of the cavities is approximately at the same radial distance as the roots of intertooth spaces. Whereas the inlet mixing cavities may have diameters greater than the width of the gear teeth, to permit gas bleed back toward the inlet, the outlet mixing cavities 80 and 81 have diameters smaller than the width of the gear teeth, so that no cavity will "straddle" or project beyond the width of the gear tooth as the tooth passes over it. That is, the width of a gear tooth, where it passes over an outlet cavity, is greater than the diameter of the cavity. This is to prevent outlet pressure from short circuiting across the gear tooth. The cavities in the plates 14 and 24 are preferably staggered, as is apparent in FIG. 6. By way of example, for use with a pump having 20-tooth gears, 16 diametral pitch with a pitch diameter of 1.250", the centers of opposite cavities 80 and 81 may be about 7° apart, as measured from the center of the gear, so that spacing between adjacent cavities on the same plate is slightly less than the 18° spacing between adjacent gear teeth. The downstream-most outlet cavity (81*a* and 81*h* in FIG. 6) may be at a 45° angle from an imaginary line connecting the gear centers; and the arc between them and upstream-most outlet cavities may suitably be about 90°.

It is our belief that, in operation, as the moving gear teeth seal and unseal the outlet mixing cavities, the gas in the respective intertooth spaces apparently expands or moves toward the cavity. This pulse creates turbulence and fluid movement within the space and thereby promotes better mixing.

The improved mixing is demonstrated by the fact that higher gas/liquid ratios can be produced without spitting, if the mixing means of the invention are incorporated into a given pump. In one instance, gas/liquid ratios as high as 3.0 could be formed, without spitting in delivery through a hot melt gun. Thus, the invention enables foam to be produced over a wider range of densities than was heretofore possible.

It is important to understand that the inlet mixing cavities will provide some improvement in mixing, even without the outlet mixing cavities; and vice versa. Either may be used in the absence of the other, that is, the inlet mixing cavity can be used without the outlet mixing cavity.

It may be noted that where both inlet mixing cavities and outlet mixing cavities are used, the two sets should be separated from one another, in the circumferential direction around each lobe; that is, there should be a space between the downstream-most inlet cavity (71*b*) and the upstream-most outlet mixing cavity (81*g*) of that lobe 50. In general, the inlet mixing cavities are most useful between gas inlet ports 65 and 66, and the liquid inlet. The outlet mixing cavities can extend upstream from the delivery slot 60 over an angular distance of 90° or even more, provided they are sufficiently spaced from the inlet cavities that no significant pressure loss or blow-by occurs. If no inlet cavities are used, then outlet mixing cavities can extend back farther toward the inlet, beyond the position shown in FIGS. 2 and 4; for example, they can extend back to a line drawn through the centers of both gears.

Figure 7:
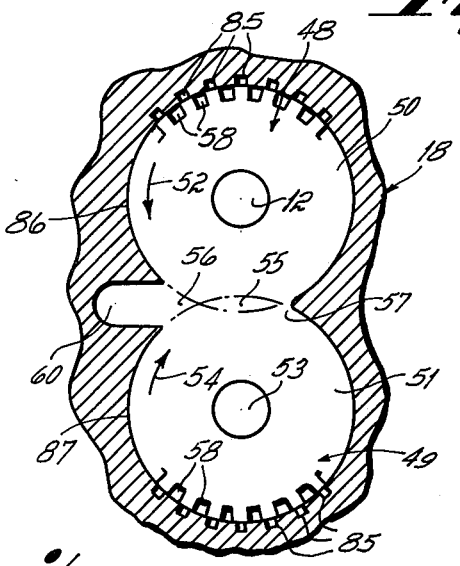
FIG. 7 is a fragmentary horizontal section showing an alternative embodiment of the invention.

In the embodiment described above, the mixing cavities are presented in the plates which cover the pumping chamber on opposite sides of the gears. As one alternative to that, the cavities can be presented in the curved sidewall of the lobe in which the gear resides. Such an arrangement is shown in FIG. 7, wherein mixing cavities 85 are formed in plate 18, in the sidewalls 86 and 87 of the lobes 50 and 51. The cavities come into and out of communication with the intertooth spaces 58 as the teeth cover and uncover them. Unlike the embodiment just described, however, it is to be noted that here the cavities are not staggered. A further difference is that the cavities here are spaced roughly equally from the inlet 57 and outlet 60 of the pumping chamber; they are isolated from both. Such cavities can be formed in the curved lobe surface by known means such as electrochemical machining ("ECM"), or electrical discharge machining ("EDM"). Although we have illustrated the mixing holes as being generally cylindrical in shape, the inlet and/or outlet mixing holes may also be formed in rectangular, triangular, or other shapes.

Figure 8:
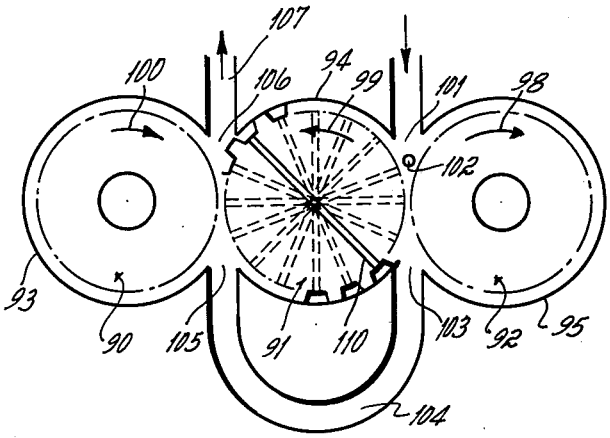
FIG. 8 is a fragmentary horizontal view showing another alternative embodiment, wherein mixing cavities are provided in a gear, in a three-gear pump.

The invention can also be incorporated in gear pumps of other types than the two spur gear type described above. FIG. 8 shows a three gear mixing pump, wherein the mixing cavities are provided in one of the gears, rather than in the surfaces defining the pumping chamber in which the gears are located.

In this embodiment, three spur gears 90, 91 and 92 are mounted for rotation in the three-lobes 93, 94 and 95 of a pumping chamber. One of the gears, e.g., gear 92, is driven in the direction of arrow 98. It in turn rotates gear 91 in the opposite direction of arrow 99. Gear 91 drives gear 90 in the direction of arrow 100. Liquid from a supply and gas from a port 102 are brought together at the inlet 101, where the teeth of gears 92 and 91 are coming out of mesh. The intertooth pockets of gear 92 carry the mixture around lobe 95, to the region 103 where its teeth begin to mesh again with the teeth of gear 91. This displaces the mixture from the intertooth spaces, and it is expelled under pressure to a passage 104 which directs it to the region 105 where the teeth of gear 90 come out of mesh with those of gear 91. The mixture is received in the intertooth spaces of gear 90, carried around the outside of lobe 93, to a region 106 where it is displaced to an outlet 107 as the teeth of gear 91 come into mesh with those of gear 90.

In this embodiment the mixing cavities are formed as diametral bores 110 which extend through gear 91, between the roots of the opposite intertooth spaces. The bores 110 do not intersect at the center; they lie in different planes. It can be seen that different pressures will act at the opposite ends of a bore 110 as one end moves past the outlet 107. The differential causes a surge toward the lower pressure pocket, adjacent region 103, and this in turn causes mixing in that space or pocket. In this instance the mixing apertures are not blind, but no substantial flow through them can occur since they are effectively closed at the end which is remote from the outlet 107.

From the foregoing description of several embodiments, it will be realized that the invention is not limited to a single form, and includes other embodiments within the scope of the following claims.

We claim:

1. In a gear pump wherein a gas under pressure and a liquid are introduced into a pumping chamber, intermixed by the action of the gear teeth which mesh in intertooth spaces in said pumping chamber and the mixture is delivered to an outlet port, mixing means for improving the dispersion of the gas in the liquid comprising, a series of blind cavities formed in a surface which adjoins said chamber, said cavities opening to said chamber, said cavities being at spaced positions along the path of movement of the teeth of at least one of said gears, said teeth wiping across the respective cavities as the gear rotates, the intertooth spaces of said gear alternately connecting to and disconnecting from the cavities in sequence as the gear rotates, the cavities when connected to the respective intertooth spaces providing additional volume into which gas in the intertooth spaces can surge, thereby improving the dispersion of the gas in the liquid.

2. The mixing means of claim 1 further wherein adjacent cavities in said series are spaced apart by approximately the width of a gear tooth, so that said gear tooth restricts flow through them.

3. The mixing means of claim 1 wherein said pump is a two gear pump.

4. The mixing means of claim 1 wherein said gears are spur gears.

5. The mixing means of claim 1 wherein said gears comprise the second stage of a two-stage pump.

6. The mixing means of claim 1 wherein said cavities are approximately centered on the gear pitch circle.

7. The mixing means of claim 1 further wherein said series of cavities is spaced from said outlet port, and said series is adjacent the region wherein the gas and liquid are admitted to said pumping chamber.

8. The mixing chamber of claim 1 wherein a first series of cavities begins adjacent an inlet region, where the gas and liquid are admitted to the pumping chamber, and wherein a second series of cavities terminates adjacent the said outlet port, said first and second series of cavities being spaced circumferentially from each other so as not to present a continuous series of cavities extending from the inlet region to the outlet port.

9. The mixing means of claim 1 wherein said series of cavities is isolated from the region where the liquid and gas are admitted to the pumping chamber and are also isolated from the outlet port.

10. The mixing means of claim 1 wherein said cavities are shallow drill holes.

11. The mixing means of claim 1 wherein said cavities are formed in a circumferential wall of said pumping chamber.

12. The mixing means of claim 1, further wherein said cavities are formed in a plate which closes said pumping chamber on one side of the gears therein.

13. The mixing means of claim 12, further wherein said cavities are formed in two opposite plates which close said pumping chamber on the opposite sides of said gears.

14. The mixing means of claim 13 further wherein the cavities in one of said opposite plates are staggered with respect to the respective cavities in the other of said opposite plates.

15. In a gear pump wherein a gas under pressure and a liquid are mixed by the action of meshing gear teeth in a pumping chamber, said gas and liquid being admitted to said pumping chamber through separate gas and liquid inlet ports, the gas inlet port being spaced downstream of the liquid inlet port, mixing means for improving the dispersion of the gas in the liquid comprising, a series of blind cavities formed in a surface which adjoins said chamber, said cavities opening to said chamber, said cavities being at spaced positions along the path of movement of the teeth of at least one of said gears, the intertooth spaces of said gear alternately connecting to and disconnecting from the cavities in sequence as the gear rotates, at least two such cavities opening to said pumping chamber between said liquid inlet port and said gas inlet port.

16. The mixing means of claim 15 wherein said two cavities are wider than the gear teeth, so as to straddle a tooth as it passes, and thereby permit gas introduced at said gas inlet port to bleed back toward said liquid inlet port.

17. In a gear pump wherein a gas under pressure and a liquid are mixed by the action of meshing gears in a pumping chamber and the mixture is delivered to an outlet port, mixing means for improving the dispersion of the gas in the liquid comprising, a series of blind cavities formed in a surface which adjoins said chamber, said cavities opening to the said chamber, said cavities being at spaced positions along the path of movement of the teeth of at least one of said gears, said teeth sealing and unsealing the respective cavities as the gear rotates, the intertooth spaces of said gear alternately connecting to and disconnecting from the cavities, the cavities when connected to the respective intertooth spaces providing additional volume into which gas in the intertooth spaces can surge, thereby improving the dispersion of the gas in the liquid, said series of cavities being spaced from the region wherein the gas and liquid are admitted to said pumping chamber, and wherein said series is adjacent said outlet port.

* * * * *